US008512104B2

(12) United States Patent
Nagy

(10) Patent No.: US 8,512,104 B2
(45) Date of Patent: Aug. 20, 2013

(54) HAND-HELD POWER TOOL, IN PARTICULAR HAND-GUIDED GRINDING MACHINE

(75) Inventor: Attila Nagy, Miskolc (HU)

(73) Assignee: Robert Bosch GmbH, Stuttgart (DE)

( * ) Notice: Subject to any disclaimer, the term of this patent is extended or adjusted under 35 U.S.C. 154(b) by 351 days.

(21) Appl. No.: 12/866,957

(22) PCT Filed: Nov. 12, 2008

(86) PCT No.: PCT/EP2008/065379

§ 371 (c)(1),
(2), (4) Date: Aug. 10, 2010

(87) PCT Pub. No.: WO2009/106163

PCT Pub. Date: Sep. 3, 2009

(65) Prior Publication Data

US 2010/0323595 A1 Dec. 23, 2010

(30) Foreign Application Priority Data

Feb. 25, 2008 (DE) ..... 10 2008 010 977

(51) Int. Cl.
*B24B 55/05* (2006.01)

(52) U.S. Cl.
USPC ..... 451/359; 451/344; 451/451; 451/452; 451/457

(58) Field of Classification Search
USPC ..... 451/344, 353, 358, 359, 451, 455, 451/457
See application file for complete search history.

(56) References Cited

U.S. PATENT DOCUMENTS

| | | | | |
|---|---|---|---|---|
| 3,969,856 | A * | 7/1976 | Zerrer | 451/451 |
| 4,905,421 | A * | 3/1990 | Maier et al. | 451/359 |
| 5,140,754 | A * | 8/1992 | Martenson | 30/390 |
| 5,351,368 | A * | 10/1994 | Borst | 24/270 |
| 5,713,785 | A * | 2/1998 | Nishio | 451/451 |
| 5,766,062 | A * | 6/1998 | Edling | 451/451 |
| 5,862,594 | A | 1/1999 | Soederqvist | |
| 6,669,544 | B1 * | 12/2003 | Walz et al. | 451/454 |
| 6,949,017 | B2 * | 9/2005 | Koschel et al. | 451/358 |
| 6,988,939 | B2 * | 1/2006 | Hofmann et al. | 451/344 |
| 7,063,606 | B2 * | 6/2006 | Stierle et al. | 451/359 |
| 7,175,513 | B2 * | 2/2007 | Folin | 451/359 |
| 7,311,589 | B2 * | 12/2007 | Wiker | 451/451 |
| 2004/0014412 | A1 | 1/2004 | Hofmann et al. | |
| 2006/0286910 | A1 * | 12/2006 | Voigt et al. | 451/359 |

FOREIGN PATENT DOCUMENTS

| | | | |
|---|---|---|---|
| DE | 4344571 | A1 | 6/1995 |
| DE | 19914855 | A1 * | 10/2000 |
| EP | 577574 | A1 * | 1/1994 |
| EP | 0 583 270 | B1 | 7/1995 |

* cited by examiner

*Primary Examiner* — Lee D Wilson
*Assistant Examiner* — Tyrone V Hall, Jr.
(74) *Attorney, Agent, or Firm* — Maginot, Moore & Beck

(57) ABSTRACT

A protective guard is provided for a hand-held power tool, in particular a hand-guided grinding machine. According to the invention, the tool is at least partially covered by the protective guard. The guard is supported in an elastically flexible fashion in the circumference direction of the bearing journal by means of a spring means that prestress locking elements of a locking mechanism in their engaged positions.

14 Claims, 5 Drawing Sheets

HAND-HELD POWER TOOL, IN PARTICULAR HAND-GUIDED GRINDING MACHINE

CROSS-REFERENCE TO RELATED APPLICATION

This application is a 35 USC 371 application of PCT/EP2008/065379 filed on Nov. 12, 2008.

BACKGROUND OF THE INVENTION

1. Field of the Invention

The invention relates to a hand-held power tool, in particular a hand-guided grinding machine, preferably a grinding machine embodied in the form of an angle grinder.

2. Description of the Prior Art

In a hand-held power tool known from EP 0 583 270 B1, which is embodied in the form of a hand-guided angle grinder, a wheel guard is provided for the tool, which is supported on a drive spindle; the wheel guard is supported by means of a hub part on the bearing journal of the housing bearing flange of the drive spindle and is embodied to be immobilized in a rotationally rigid fashion in a plurality of rotation positions by means of a locking device.

The hub part is embodied in the form of a hat-shaped sheet metal cap that is slid axially onto the bearing journal and axially immobilized relative to it in a form-locked fashion.

The locking device, which has locking elements acting between the hub part and the bearing journal, includes an annular body situated between a shoulder of the bearing flange and the rim of the hat-shaped sheet metal cap that constitutes the hub part; the annular body is rotationally fixed relative to the bearing flange and has an annular section that is bent out toward the rim and is prestressed in a resilient fashion in the axial direction, i.e. toward the rim. This ring section has a latch lug as a locking element, which corresponds to recesses in the rim that are spaced apart from one another in the circumference direction and function as receiving locking elements. The ring section supporting the latch lug is provided with an actuating button that can be used to manually release the rotationally rigid locking in order to move the rotation position of the wheel guard.

In another locking device for a wheel guard rotatably supported on the bearing journal of the drive spindle of an angle grinder known from DE 37 44 218 A1, the locking engagement occurs not axially, but radially and in one embodiment, by means of a two-armed lever that is linked to the housing by means of a pivot axis parallel to the axis of the working spindle. At its one end, the pivoting lever is provided with a locking element in the form of a latch lug that is associated with radial recesses that are spaced apart from one another in the circumference direction on the circumference of a hub part of the wheel guard encompassing the bearing journal. The other arm of the pivoting lever functions as an actuating button and is spring-loaded in the pivoting direction corresponding to the engagement direction of the latch lug in the respective recess.

In this embodiment as well, the wheel guard is supported in a rotationally rigid fashion in its respective locked rotation position.

The rotationally rigid support results in the fact that in the event of damage to the tool, e.g. when a grinding wheel bursts and as a result, wheel fragments become wedged against the wheel guard or when a tool fragment becomes wedged between the tool and wheel guard, in particular the wheel guard and/or its locking device can be damaged.

OBJECT AND SUMMARY OF THE INVENTION

This object is attained according to the invention with the defining characteristics of claim 1. The dependent claims disclose suitable modifications as well as a stand-alone embodiments with regard to the design of the locking mechanism.

The starting point for the embodiment according to the invention is to use a respective locking mechanism to fix the wheel guard, which is provided so that it overlaps the tool circumferentially, in a rotation position that is in particular predetermined by the operating conditions and the intended use. This locking mechanism thus predetermines a respective desired position for the wheel guard from which the wheel guard is able to give way in the circumference direction when acted on with a corresponding force while maintaining the locked position thanks to the elastically flexible support. The elastically flexible support can be provided on the wheel guard and/or on the locking mechanism and in a particularly suitable embodiment, the wheel guard is supported in an elastically flexible fashion in the drive direction of the drive spindle. According to the invention, a respective safety position for the wheel guard is defined by means of a swiveling range around a locked position within which range the wheel guard is able to swivel thanks to the elastically flexible support in this locked position.

In a particularly simple, suitable embodiment, in its respective locked position, the wheel guard is supported in an elastically flexible fashion in the circumference direction of the bearing journal by means of the spring means that prestress the locking elements of a locking mechanism in their engaged positions.

This can be achieved in a particularly simple way by means of spring means embodied in the form a torsion spring bent into a U-shape, with a locking leg and a fastening leg that are connected by means of its U-shaped vertex bend; the fastening leg is fastened to the housing and the locking leg has locking elements that engage with locking elements provided on the side of the collar of the hub and extends transversely to the axis of the drive spindle.

Within the scope of the present invention, the torsion spring can be situated with a spring plane extending transversely relative to the axis of the drive spindle or, in a preferred embodiment of the invention, with a spring plane extending in the direction of the axis of the drive spindle. In both cases, the embodiment in the form of a torsion spring and the connection of the legs by means of the vertex bend must also achieve a flexibility in the longitudinal direction of the legs that results in the elastically flexible support of the wheel guard in a safety position relative to a respective predetermined locked position.

The torsion spring is suitably embodied in the form of a leaf spring with a flat locking leg and flat fastening leg, each oriented transversely relative to the spring plane; the legs are able to pivot relative to each other in the direction of the spring plane by means of the vertex bend, as a result of which it is possible to achieve powerful clamping forces for the locking and powerful supporting forces for the elastic support. These forces can also be influenced in their intensity and their ratio to one another by virtue of the fact that the fastening leg and the locking leg extend at an angle to each other, viewed in the direction of the spring plane, resulting in an offset of the torsion spring in the region of the vertex bend. Such an offset also has the advantage that the legs extend transversely relative to the spring plane, offset from each other by an angle so that a fastening screw that passes through the fastening leg in the vicinity of the vertex bend lies outside the overlap region of the locking leg and is thus easily accessible.

Other advantages and suitable modifications can be inferred from the remaining claims, the description of the figures, and the drawings.

DESCRIPTION OF THE PREFERRED EMBODIMENTS

Figure 1:
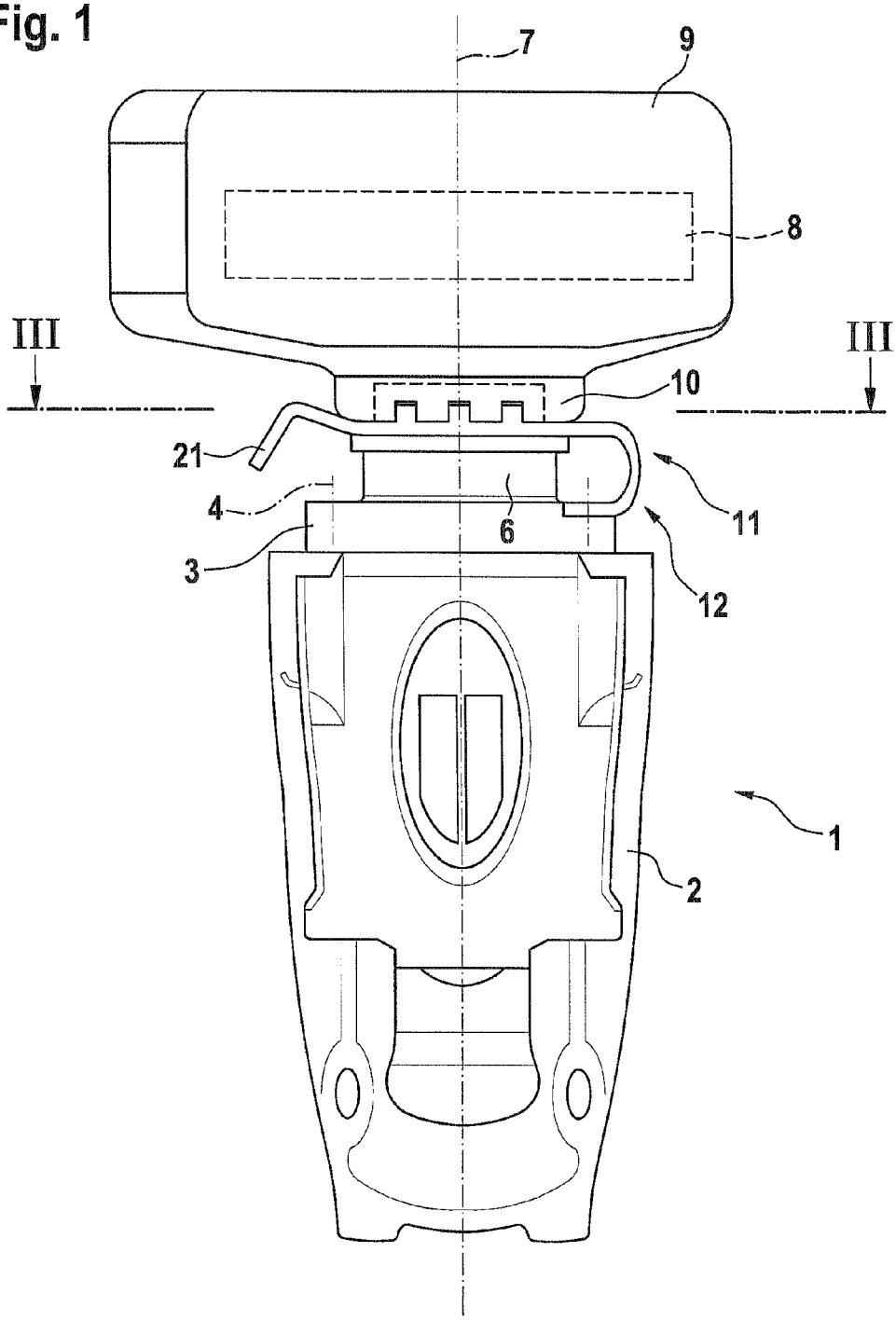
FIG. 1 is a schematic top view of a hand-held power tool in the form of a hand-guided grinding machine according to the invention.
Figure 2:
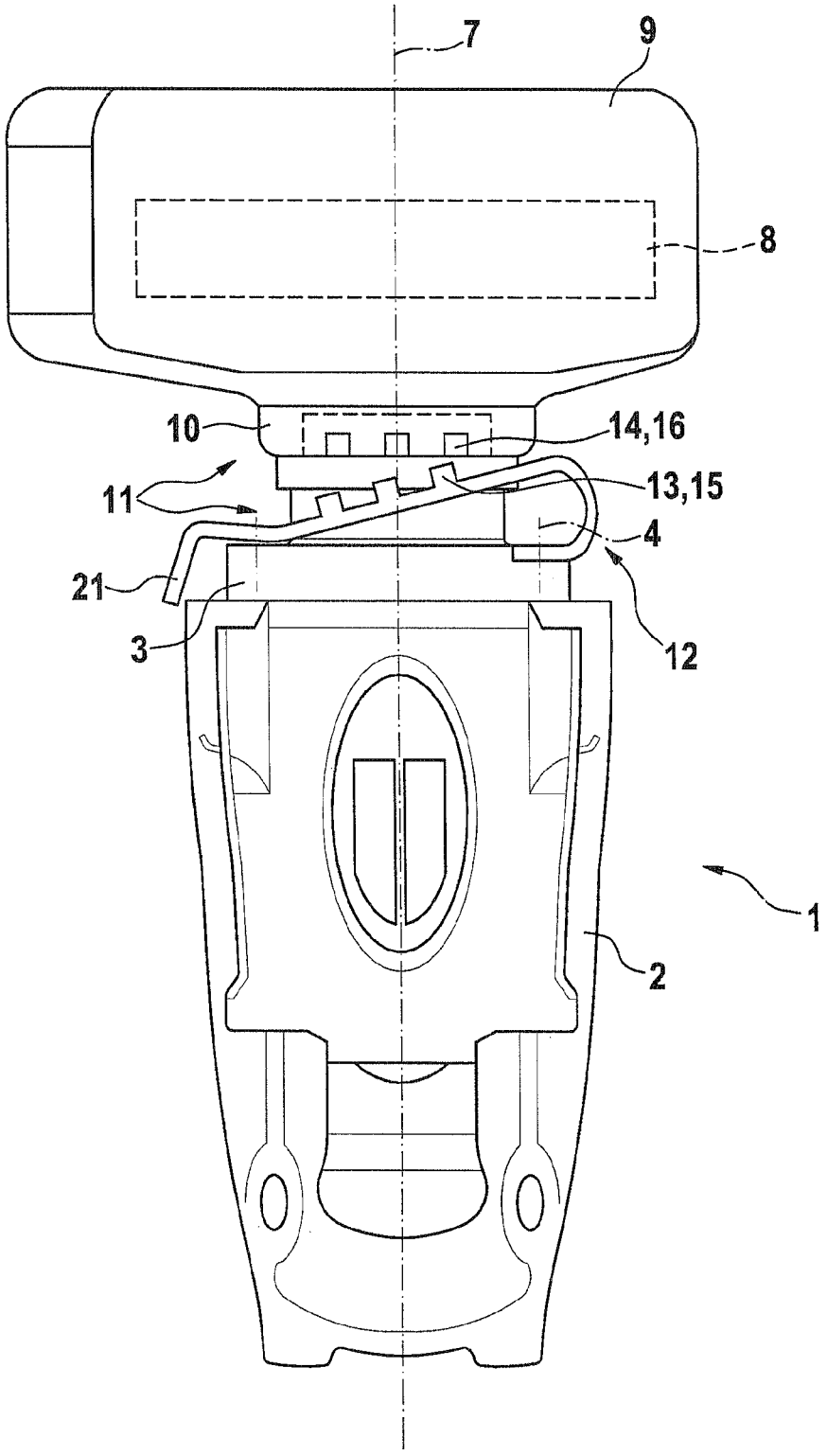
FIG. 2 is a depiction corresponding to the one in FIG. 1, in which the locking mechanism is shown in its unlocked position.

FIGS. 1 and 2 show corresponding side-view depictions of a hand-held power tool embodied in the form of a hand-guided grinding machine 1. In the exemplary embodiment, the grinder 1 is embodied in the form of an electrically driven machine and has a housing 2, which in a known fashion not depicted here, accommodates a drive unit with a motor and a subsequent transmission and in the exemplary embodiment, is connected at one of its axial ends to a bearing flange 3—by means of screws in the exemplary embodiment. These axial screw connections are labeled with the reference numeral 4 here.

Figure 3:
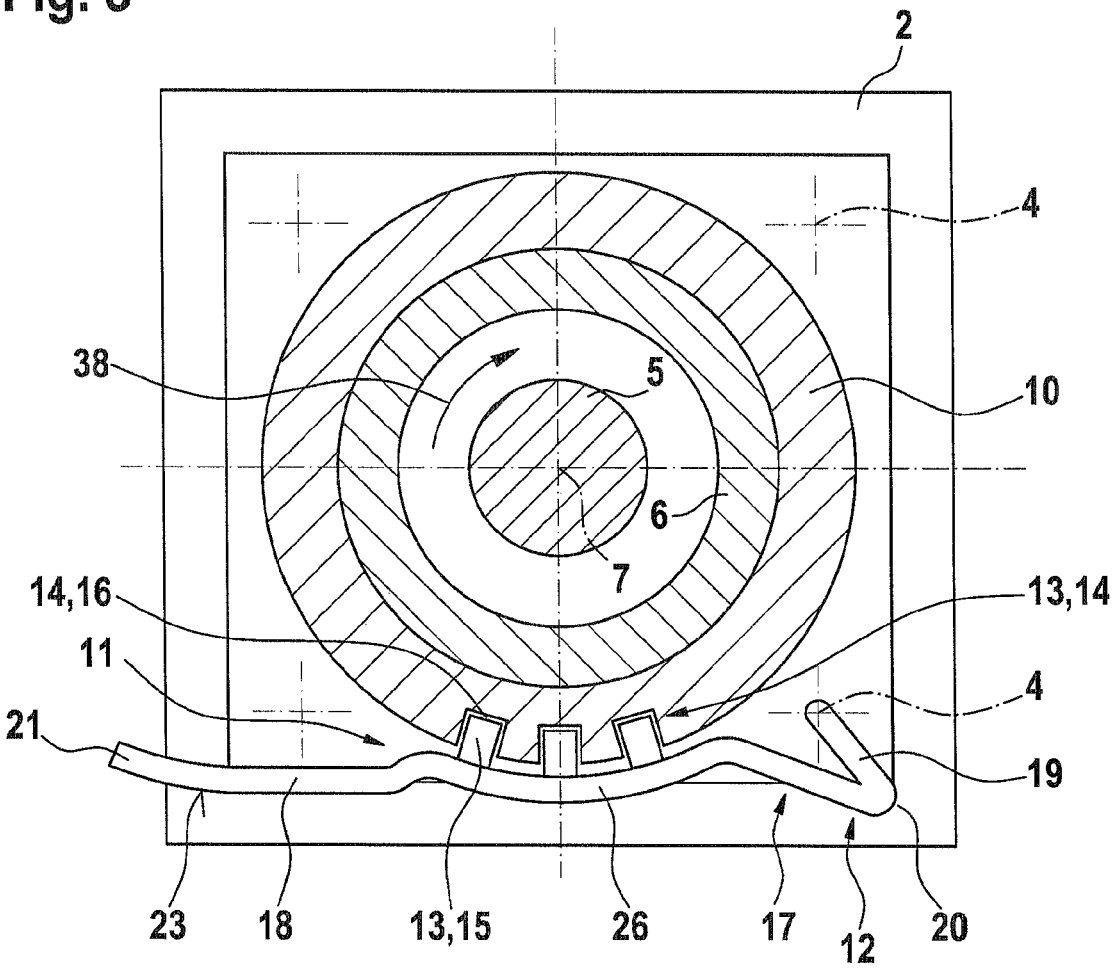
FIG. 3 is a schematic depiction along a cutting line III-III from FIG. 1, in which the locking mechanism includes spring means whose spring plane extends transversely, in particular perpendicularly, relative to the plane of the drawing and thus approximately in the longitudinal direction of the axis of the drive spindle.

As shown in FIG. 3, the bearing flange (see also FIGS. 1 and 2) has a drive spindle 5 passing through it—whose drive direction is labeled with the reference numeral 38—and transitions into a bearing journal 6. The drive spindle 5 extends at least approximately coaxial to the bearing journal 6. The rotational and longitudinal axis of the drive spindle 5 is labeled with the reference numeral 7. At one end, the drive spindle 5 supports a tool 8, which is not shown in detail. The tool 8 is preferably embodied in the form of a grinding or cutting wheel that is driven to rotate. Over at least part of its circumference, the tool 8 is encompassed by a wheel guard 9 that is guided in rotating fashion on the bearing journal 6 by means of its hub part embodied in the form of a collar 10 and is axially fixed, not shown here, relative to the bearing journal 6.

The collar 10 is composed of a collar that protrudes laterally from the wheel guard 9, i.e. in the direction of the rotational and longitudinal axis 7, and overlaps the bearing journal 6.

In accordance with work requirements, the wheel guard 9 must be fixed in various rotation positions relative to the rotational and longitudinal axis 7.

This is accomplished by means of a locking mechanism 11, which, in a first embodiment according to FIGS. 1 through 3, has spring means 12 associated with locking elements 13 that correspond to locking elements 14 provided on the wheel guard 9 and associated with the collar 10. In the exemplary embodiment, the locking elements 13 provided on the spring means 12 are embodied in the form of protruding tabs 15 that correspond to locking elements 14 in the form of recesses 16 provided in the collar 10.

In the exemplary embodiment according to FIGS. 1 through 3, the spring means 12 are embodied in the form of a U-shaped torsion spring 17 that has a locking leg 18, a fastening leg 19, and a U-shaped vertex bend 20 that connects the legs. When arranged according to FIGS. 1 through 3, the spring plane of the U-shaped torsion spring 17 extends axially, i.e. in the longitudinal direction of the rotational and longitudinal axis 7 and thus parallel to the plane of the drawing in the view shown in FIGS. 1 and 2 and perpendicular to the plane of the drawing in the sectional view according to FIG. 3.

When they coincide radially with the recesses 16, the tabs 15 correspondingly engage in them axially in their locked position (FIG. 1) and are pivoted out from the recesses 16 essentially in an axial direction according to the depiction in FIG. 2.

This is achieved by the fact that the locking leg 18 and fastening leg 19, which are connected to each other essentially in a U-shape, are connected offset from each other in the axial direction by means of the vertex bend 20 extending in the axial direction so that the legs 18, 19—and thus also the handle 21 provided at the free end of the locking leg 18—are able to pivot relative to each other around an imaginary pivoting axis defined by the vertex bend 20.

Figure 5:
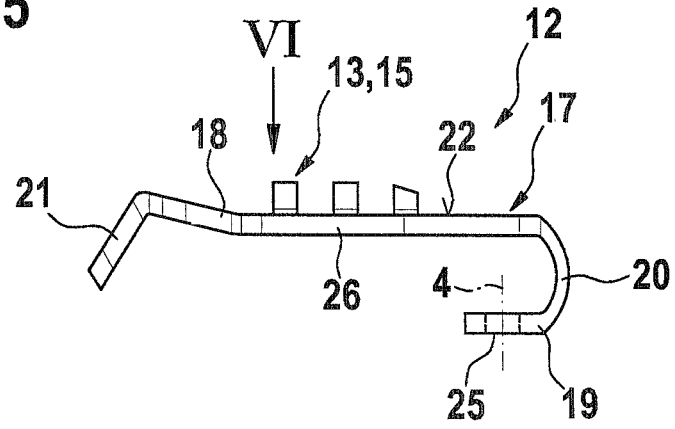
FIG. 5 shows a first depiction of the torsion spring in a side view perpendicular to the spring plane and in a spring position that corresponds to its locked position.
Figure 6:
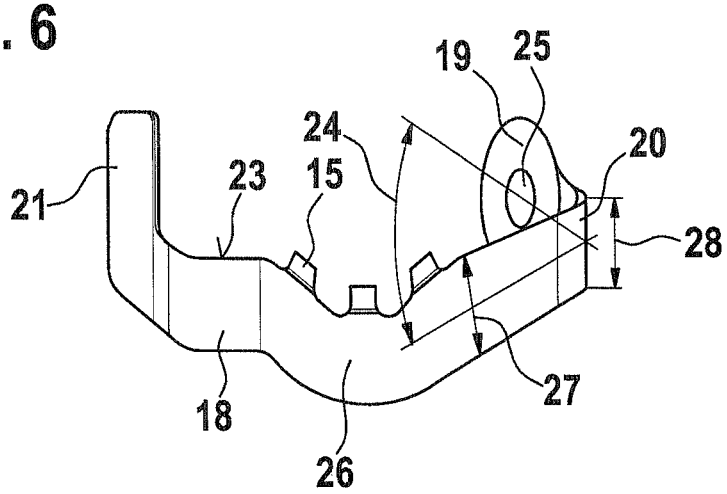
FIG. 6 shows the torsion spring according to FIG. 5 in the viewing direction according to the arrow V.
Figure 7:
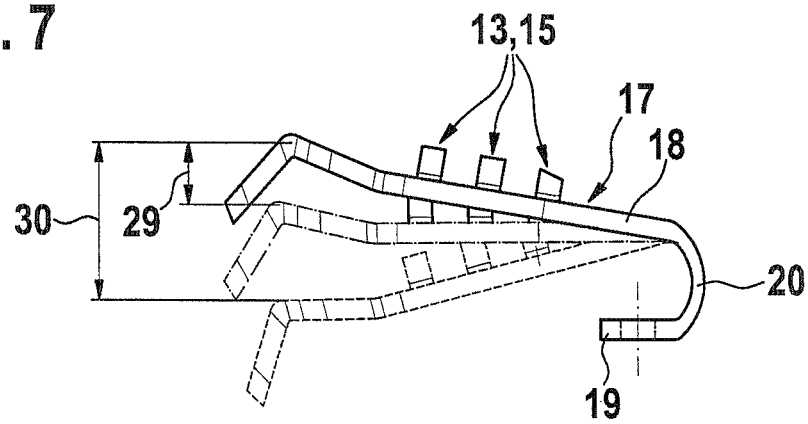
FIG. 7, in a side view that corresponds to the one in FIG. 5, shows different spring positions of the torsion spring.

The U-shaped torsion spring 17 is preferably embodied, as shown in FIGS. 1 through 3, in the form of a leaf spring curved into a U-shape, in fact with broad sides 22 situated transversely relative to the spring plane and narrow sides 23 extending in the direction of the spring plane, as also shown particularly in FIGS. 5 through 7.

FIGS. 5 through 7, in particular FIG. 6, also show that in a top view of the U-shaped torsion spring 17 in the direction of arrow VI in FIG. 5, the locking leg 18 and the fastening leg 19 preferably extend at an angle 24 to each other, as a result of which, in the top view according to FIG. 5, the screw hole 25 provided in the fastening leg 19 and associated with the screw connection 4 is situated with an at least partial overlap—preferably with at least essentially no overlap—relative to the locking leg 18, therefore permitting the spring means 12 in the form of the torsion spring 17 to be easily screw-mounted to the end surface of the bearing flange 3, as shown in FIGS. 1 and 2. The offset of the torsion spring 17 in the region of the vertex bend 20 also offers the possibility of positioning the torsion spring 17 with the locking leg 18 and fastening leg 19 extending in opposite directions with regard to the circumference direction of the bearing journal 6, with the locking leg 18 extending transversely relative to the rotational and longitudinal axis 7, essentially tangential to the bearing journal 6 and, as shown in FIG. 6, in the region of the locking elements 13, which are provided on the locking leg 18 and embodied in the form of the tabs 15, is convexly curved toward the radial outside, thus producing a curve contour of the locking leg 18 that corresponds to the circumference contour of the collar 10 in the locking region.

If the locking leg 18 were supported by means of the fastening leg 19 and U-shaped vertex bend 20 in an essentially inflexible fashion transverse to the rotational and longitudinal axis 7, this would result in a locked position of the wheel guard 9 that was rotationally fixed, i.e. that was immobilized in a rotationally fixed fashion in its respective rotation position in the circumference direction of the bearing journal 6.

Such a support of the wheel guard 9 by means of the torsion spring 17 in its above-explained embodiment is in fact quite advantageous in comparison to known embodiments since it permits—through means that are simple from an assembly and embodiment standpoint and are therefore inexpensive—a basic setting of the wheel guard 9 in different locked positions, and this solely based on the resilient flexibility of the locking leg 18 in the direction of the locking plane, which in FIGS. 1 through 3, extends along the rotational and longitudinal axis 7. Such a locking mechanism correspondingly also constitutes a stand-alone embodiment of the invention.

If in the context of the embodiment according to the invention, the U-shaped torsion spring 17 is also embodied so that the locking leg 18 is not only resiliently flexible in the direction of the locking plane and therefore transversely relative to its span, but is also connected to the fastening leg 19 in such a way that it is supported in a flexible fashion in its longitudinal direction when a corresponding load is exerted on the wheel guard 9 in the circumference direction, thus resulting in—depending on the torque being withstood by the wheel guard 9—a safety position, which is displaced, as a function of the elastically flexible support, in the circumference direction while maintaining the respective locked position. In other words, relative to a respective locked position, the elastically flexible support defines a sector as a swiveling range by means of which the safety position can change as a function of the torque to be withstood.

In the above-described embodiment, the support of the wheel guard 9 in its safety position in an elastically flexible fashion in the rotation direction in a respective locked position or in relation to a respective locked position is achieved by means of a corresponding flexibility of the spring means 12, i.e. the torsion spring 17, which is in turn rigidly connected to the bearing flange 3 and therefore also to the bearing journal 6 by means of the fastening leg 19. A corresponding effect can therefore be at least partially achieved or also supplementarily achieved in the context of the invention by virtue of the fact that in lieu of the rigid screw connection 4, the fastening leg 19 is fastened by means of an elastic connection to the bearing flange 3 or another part affixed to the housing.

With regard to the flexible support of the locking leg 18 in the direction of the spring plane and/or with regard to the initial position predetermined by a respective locked position of the locking mechanism 11, for a safety position relative to this initial position, which safety position can be achieved by means of an elastically flexible support of the wheel guard 9 in the rotation direction, it turns out to be suitable to provide the torsion spring 17 with a changing cross section in the region of its U-shaped vertex bend 20 and/or the region(s) of the locking leg 18 extending from it and/or the fastening leg 19; a preferred embodiment is shown in FIG. 6, in which the region of the locking leg 18 approaching its curved region 26 that supports the locking elements 13 in the form of tabs 15 is provided with a greater width 27 than the region composed of the vertex bend 20, which has a width 28. Corresponding effects can be achieved and possibly also amplified by changing the respectively supporting cross section, for example by providing recesses, ribs, or the like, which is not shown.

FIG. 7 shows positions of the locking leg 18 of the torsion spring 17 in its non-installed initial position, which is depicted with solid lines. The middle position of the torsion spring 17 depicted with dot-and-dash lines corresponds to a locked position according to FIG. 1 and to a position according to FIG. 5 in which a clamping force that corresponds to the pivoting distance 29 has been built up. The torsion spring 17 is consequently prestressed toward its locked position and in order to move it into the unlocked position, which is depicted with dashed lines as a third position, it is necessary to overcome an increased pivoting distance 30, so that even with a possible increase in the torque exerted by the wheel guard 9, which may result in a force being exerted on the locking leg 18 in the direction toward its unlocked position, correspondingly greater prestressing forces are built up.

The embodiment according to the invention consequently features not only a rugged, simple design and self-evident operation, but also a high degree of locking safety.

In particular, the embodiment according to the invention also assures that even with abruptly occurring torque loads that can arise, for example, when a grinding and/or cutting wheel bursts and wheel parts, wheel fragments, and/or other objects become jammed between the drive spindle 5 and wheel guard 9, both the wheel guard 9 and the locking mechanism 11 and/or the drive spindle 5 and its bearing are protected, at least as a rule, from occurrences of damage that would require replacement of these parts and therefore trigger a repair procedure.

Figure 4:
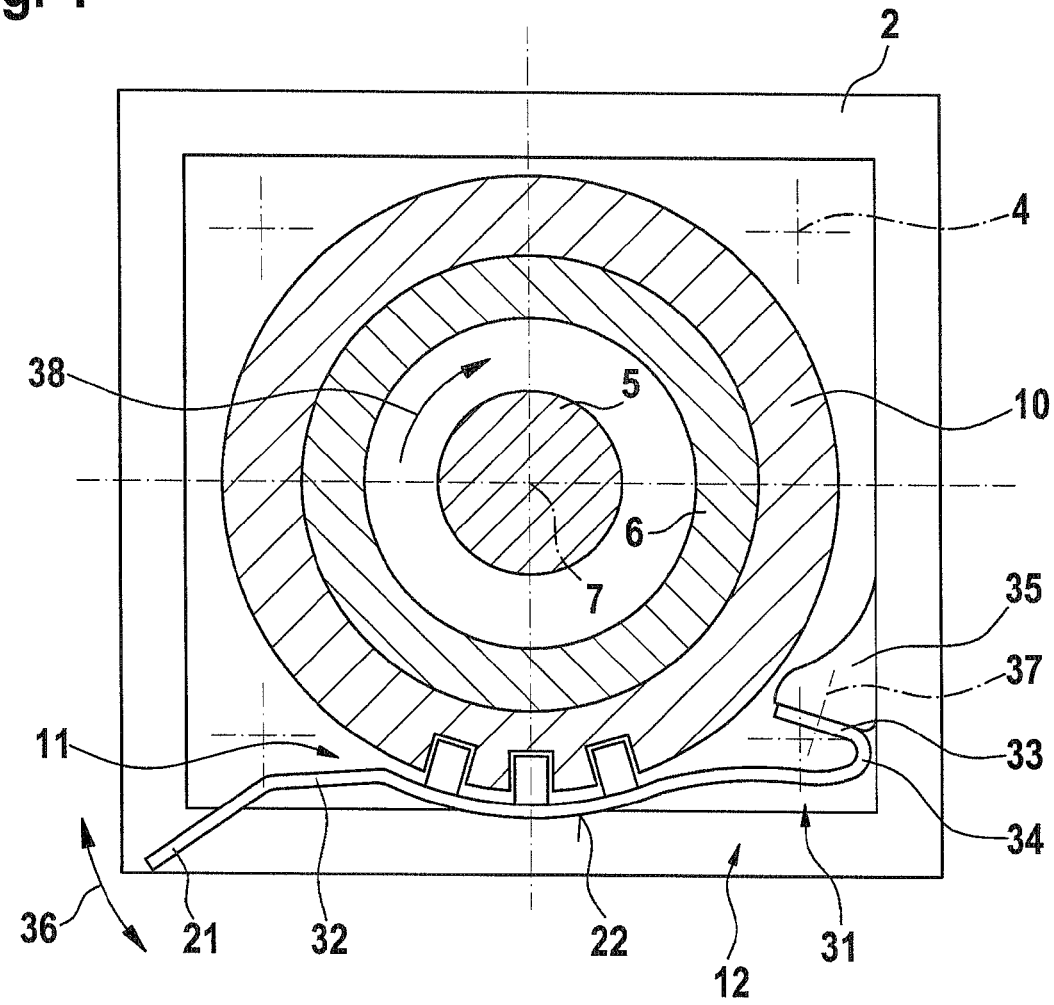
FIG. 4 is a depiction corresponding to the one in FIG. 3, but by contrast with FIG. 3, shows spring means whose spring plane extends along the plane of the drawing, in particular parallel to the plane of the drawing, and therefore transversely, in particular radially, relative to the axis of the drive shaft.

As explained above, FIGS. 1 through 3 are based on an arrangement of a torsion spring 17 with a spring plane extending in the longitudinal direction of the rotational and longitudinal axis 7. In a depiction whose basic embodiment corresponds to the one in FIG. 3, FIG. 4 shows an alternative arrangement of a U-shaped torsion spring 31, which, analogous to FIGS. 1 through 3 once again has a locking leg 32, a fastening leg 33, and a U-shaped vertex bend 34 that connects these legs 32, 33. The fastening leg 32, as symbolically depicted, is supported by means of a screw connection 37 for example on a support block 35 that is provided protruding axially from the bearing flange 3.

Alternative to the embodiment according to FIGS. 1 through 3, the torsion spring 31 in the embodiment according to FIG. 4 is situated so that between the locked position shown and the unlocked position not shown, there is a pivoting path 36 relative to the collar 10, extending radial to the rotational and longitudinal axis 7 for the locking leg 32 and resulting in a spring plane parallel to the plane of the drawing in FIG. 4, with an engagement of the locking elements 13, embodied in the form of tabs 15 (as labeled in FIG. 3), in the radial direction relative to the rotational and longitudinal axis 7, which engagement can be adjusted by means of a handle 21 of the locking leg 32. In this embodiment as well, the torsion spring 31 is preferably embodied in the form of a leaf spring with narrow sides extending in the direction of the spring plane and broad sides 22 extending transversely relative to the spring plane.

When considering the differences between the radial and axial engagement between the locking elements 13 and the collar 10, it is functional to provide ratios that largely correspond to each other, which can also be taken into account in a simple way through structural adaptations so that for the two embodiments shown in analogous fashion in FIGS. 3 and 4, the explanations of FIGS. 1 through 3 apply to the appropriate adaptations.

The invention thus yields a plurality of embodiments for presetting a swiveling range for the wheel guard 9 in its safety position, said range being determined by elastic flexibility. This is because in its safety position, the wheel guard has an elastically flexible swiveling range relative to a locking mechanism in a respective locked position, whether due to a rotationally elastic support between the locking elements or a rotationally elastic connection situated subsequently in the transition to the wheel guard 9. In another embodiment, when the locking mechanism 11 is in a respective locked position relative to the wheel guard 9, an elastically flexible swiveling range can be created for the wheel guard 9 in its safety position by mounting the locking mechanism 11 to the housing in an elastic fashion. Finally, when the locking mechanism is in a respective locked position relative to the wheel guard 9, a swiveling range that is supported in an elastically flexible fashion can be achieved according to the invention for the wheel guard 9 in its safety position by means of an intrinsically elastic embodiment of the locking mechanism; the intrinsically elastic embodiment is achieved, for example, by spring means 12, as explained above in the form of torsion springs 17 or 31.

The foregoing relates to the preferred exemplary embodiments of the invention, it being understood that other variants and embodiments thereof are possible within the spirit and scope of the invention, the latter being defined by the appended claims.

The invention claimed is:

1. A hand-held power tool, comprising:

a drive spindle;

a tool supported by the drive spindle;

a wheel guard configured to at least partially cover the tool, the wheel guard having at least one first locking element;

a bearing journal rotatably supporting the wheel guard; and a spring including (i) a locking leg extending direction in a longitudinal direction and having at least one second locking element configured to physically interact with the at least one first locking element, (ii) a fastening leg fixed in relation to the bearing journal, and (iii) a flexible connection interconnecting the locking leg and the fastening leg, wherein the spring is configured to move in (i) a first path of movement in which the locking leg pivots from a first position to a second position, and (ii) a second path of movement in which the locking leg travels in substantially the longitudinal direction from the first position to a third position, wherein the at least one first locking element is positioned in mating relationship with the at least one second locking element when the locking leg is located in the first position, wherein the at least one first locking element is positioned out of mating relationship with the at least one second locking element when the locking leg is located in the second position, and wherein the at least one first locking element is positioned in mating relationship with the at least one second locking element when the locking leg is located in the third position.

2. The hand-held power tool as recited in claim 1, wherein the wheel guard is supported in a rotationally elastic fashion relative to the bearing journal by the spring.

3. The hand-held power tool as recited in claim 2, wherein the wheel guard is supported in an elastically flexible fashion in a drive rotation direction of the drive spindle by the spring.

4. The hand-held power tool as recited in claim 1, wherein the wheel guard is supported in an elastically flexible fashion in a drive rotation direction of the drive spindle by the spring.

5. The hand-held power tool as recited in claim 1, wherein the spring is embodied in the form of a torsion spring.

6. The hand-held power tool as recited in claim 5, wherein the torsion spring is configured with a U-shape.

7. The hand-held power tool as recited in claim 1, further comprising a housing that supports the bearing journal, wherein the fastening leg is affixed to the housing.

8. The hand-held power tool as recited in claim 1, wherein the at least one second locking elements includes a plurality of tabs.

9. The hand-held power tool as recited in claim 1, wherein:

a spring plane extends transversely to a rotational axis of the drive spindle, and the torsion spring is embodied in the form of a leaf spring with broad sides of the locking leg and fastening leg, each oriented transversely relative to the spring plane, being able to pivot relative to each other in the direction of the spring plane by the flexible connection.

10. The hand-held power tool as recited in claim 9, wherein the fastening leg and the locking leg extend at an angle relative to each other, viewed in a direction of the spring plane.

11. The hand-held power tool of claim 1, wherein the locking leg is biased toward the first position.

12. The hand-held power tool of claim 1, wherein the wheel guard is configured to rotate relative to the bearing journal when the locking leg is located in the second position.

13. The hand-held power tool of claim 12, wherein rotation of the wheel guard causes movement of the spring in the second path of movement.

14. The hand-held power tool of claim 1, wherein:

the drive spindle is configured to rotate about an axis, a first plane is positioned perpendicular to the axis, a second plane is positioned perpendicular to the first plane, when the spring moves in the first path of movement, the locking leg travels along the second plane, and when the spring moves in the second path of movement, the locking leg travels along the first plane.

* * * * *